US008946135B2

(12) United States Patent
Crawley et al.

(10) Patent No.: US 8,946,135 B2
(45) Date of Patent: Feb. 3, 2015

(54) LUBRICATING COMPOSITION CONTAINING A NITRILE COMPOUND

(75) Inventors: Seth L. Crawley, Mentor, OH (US); Jody A. Kocsis, Chagrin Falls, OH (US); Matthew D. Gieselman, Wickliffe, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 399 days.

(21) Appl. No.: 13/515,305

(22) PCT Filed: Dec. 10, 2010

(86) PCT No.: PCT/US2010/059803

§ 371 (c)(1),
(2), (4) Date: Aug. 23, 2012

(87) PCT Pub. No.: WO2011/075401

PCT Pub. Date: Jun. 23, 2011

(65) Prior Publication Data

US 2012/0309655 A1 Dec. 6, 2012

Related U.S. Application Data

(60) Provisional application No. 61/286,100, filed on Dec. 14, 2009.

(51) Int. Cl.
*C10M 133/24* (2006.01)
*C10M 135/12* (2006.01)

(52) U.S. Cl.
CPC ..... *C10M 133/24* (2013.01); *C10M 135/12* (2013.01); *C10M 2207/028* (2013.01); *C10M 2207/042* (2013.01); *C10M 2207/124* (2013.01); *C10M 2207/128* (2013.01); *C10M 2207/26* (2013.01); *C10M 2207/262* (2013.01); *C10M 2207/289* (2013.01); *C10M 2215/04* (2013.01); *C10M 2215/086* (2013.01); *C10M 2215/16* (2013.01); *C10M 2215/223* (2013.01); *C10M 2219/046* (2013.01); *C10M 2219/06* (2013.01); *C10M 2219/062* (2013.01); *C10M 2219/089* (2013.01); *C10M 2223/043* (2013.01); *C10M 2223/045* (2013.01); *C10N 2230/06* (2013.01); *C10N 2230/42* (2013.01); *C10N 2230/43* (2013.01); *C10N 2230/45* (2013.01); *C10N 2240/10* (2013.01)
USPC ..... 508/551; 508/567; 508/545; 508/370; 123/1 A

(58) Field of Classification Search
USPC ..... 508/370, 561, 545, 557; 123/1 A
See application file for complete search history.

(56) References Cited

U.S. PATENT DOCUMENTS

| | | | | |
|---|---|---|---|---|
| 3,119,777 | A * | 1/1964 | Lauer | 508/447 |
| 3,127,349 | A * | 3/1964 | Rockett | 508/297 |
| 3,366,569 | A | 1/1968 | Norman et al. | |
| 3,463,804 | A | 8/1969 | Ray et al. | |
| 3,493,658 | A | 2/1970 | Schmidt et al. | |
| 3,896,050 | A | 7/1975 | White | |
| 3,984,336 | A | 10/1976 | Cier et al. | |
| 4,012,408 | A | 3/1977 | White | |
| 4,025,446 | A | 5/1977 | Cier et al. | |
| 4,031,015 | A | 6/1977 | Miller | |
| 4,058,469 | A | 11/1977 | Hoke | |
| 4,209,408 | A | 6/1980 | Hoke | |
| 4,331,549 | A | 5/1982 | Bremer | |
| 5,683,618 | A | 11/1997 | Sabahi | |
| 2005/0184466 | A1 * | 8/2005 | Yoshida et al. | 277/468 |
| 2006/0116299 | A1 * | 6/2006 | Arrowsmith et al. | 508/443 |
| 2006/0183652 | A1 | 8/2006 | Fujitsu et al. | |
| 2006/0189489 | A1 | 8/2006 | Fujitsu et al. | |

FOREIGN PATENT DOCUMENTS

| | | |
|---|---|---|
| FR | 1258718 | 4/1961 |
| GB | 1097360 | 1/1968 |
| GB | 1165226 | 9/1969 |
| GB | 1538889 | 1/1979 |
| WO | 90/06979 | 6/1990 |
| WO | 2010033447 | 3/2010 |

OTHER PUBLICATIONS

Avram et al., Romanian Journal publication "Revista de Chimie", (Bucharest, Romania) (1981) 32(7), pp. 686-687, also available as CAS Abstract document No. 96:165183, also attached.
Corresponding PCT Publication No. WO2011/075401 A1 and Search Report published Jun. 23, 2011.
Written Opinion from corresponding International Application No. PCT/US2010/059803 dated Feb. 25, 2011.

* cited by examiner

*Primary Examiner* — James Goloboy
(74) *Attorney, Agent, or Firm* — Michael F. Esposito, Esq.; David M. Shold, Esq.

(57) ABSTRACT

The invention provides a lubricating composition containing an oil of lubricating viscosity and a nitrile compound. The invention further relates to a method of the lubricating an internal combustion engine with the lubricating composition.

19 Claims, No Drawings

LUBRICATING COMPOSITION CONTAINING A NITRILE COMPOUND

FIELD OF INVENTION

The invention provides a lubricating composition containing a nitrile compound and an oil of lubricating viscosity. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Friction modifiers and other additives may also increase lead corrosion.

Further, engine lubricants containing phosphorus and sulphur compounds such as ZDDP have been shown to contribute in part to particulate emissions and emissions of other pollutants. In addition, sulphur and phosphorus tend to poison the catalysts used in catalytic converters, resulting in a reduction in performance of said catalysts.

There has been a commercial trend for reduction in emissions (typically reduction of NOx formation, SOx formation) and a reduction in sulphated ash in engine oil lubricants. Consequently, the amounts of phosphorus-containing antiwear agents such as ZDDP, overbased detergents such as calcium or magnesium sulphonates and phenates have been reduced. As a consequence, ashless additives have been contemplated to provide friction or antiwear performance. It is known that surface active ashless compounds such as ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives.

U.S. Pat. No. 3,127,349 discloses a composition optionally containing a nitrile ester capable of increasing the viscosity index of an oil containing a viscosity index improver and attenuating viscosity index decrease over time.

U.S. Pat. No. 3,366,569 discloses a composition resulting from contacting an alkylene polyamine with a hydrocarbyl substituted acylating agent and a nitrile such as acrylonitrile. The composition provides detergency and rust protection.

U.S. Pat. No. 4,025,446 discloses the use of several polynitrile compounds as effective anti-wear agents.

U.S. Pat. No. 4,209,408 discloses a lubricating composition containing at least one polyfunctional sulphur-containing nitrile.

U.S. Pat. Nos. 4,012,408 and 3,896,050 disclose a copper corrosion inhibitor derived from a cyano-substituted isothiazole.

U.S. Pat. No. 4,031,015 discloses oil-soluble compositions containing the reaction product of an olefin with an α,β-unsaturated nitrile to form an organonitrile. The organonitrile is then reacted with an amine or polyamine.

British Patent GB 1 538 889 discloses a lubricating composition containing a nitrile compound having either (i) an aliphatic thioether group, or (ii) an aliphatic ether group.

U.S. Pat. No. 4,058,469 discloses the use of polyfunctional nitriles as effective seal swelling agents and demulsifiers.

US Patent Application 2006/0189489 A1 discloses a lubricating composition containing base oil, glycerol monooleate, and one or more nitriles.

US Patent Application 2006/183652 discloses a lubricating composition containing base oil, oleylamide, an ether and at least one nitrile.

Romanian journal publication Revistade Chimie (Bucharest, Romania) (1981), 32(7), 686-7 discloses motor oil containing 0.5 wt % to 1 wt % of four nitriles as corrosion inhibitors, extreme pressure agents or antiwear agents. The nitriles include dodecylnitrile, stearylnitrile, oleylnitrile, and mixed-nitrile derivatives of linseed oil.

SUMMARY OF THE INVENTION

The inventors of this invention have discovered a lubricating composition that is capable of providing at least one of antiwear performance, friction modification (particularly for enhancing fuel economy), extreme pressure performance, antioxidant performance, lead or copper (typically copper) corrosion inhibition, or seal swell performance.

As used herein reference to the amounts of additives present in the lubricating composition disclosed herein are quoted on an oil free basis, i.e., amount of actives.

In one embodiment the present invention provides a lubricating composition comprising an oil of lubricating viscosity and a nitrile compound obtained/obtainable by a process comprising reacting a cyano-substituted carboxylic acid with a compound selected from the group consisting of an alcohol, a thiol, an amine and an aminoalcohol.

In one embodiment the present invention provides a lubricating composition comprising an oil of lubricating viscosity and a nitrile compound represented by formula (1):

formula (1)

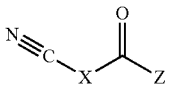

wherein

X may be a linear or branched hydrocarbylene group, or a heteroatom-containing hydrocarbylene group (such as —$CH_2$—O—$CH_2$—, or —$CH_2CH_2$—O—$CH_2CH_2$—, or —C($CH_3$)H—O$CH_2$— or —C($CH_3$)H$CH_2$—O—$CH_2CH_2$—, (typically X may be a linear or branched hydrocarbylene group);

Z may be —OR, —NRR', a hydrocarbyl group (such as alkyl, aryl, or alkaryl), or —S—R, (typically z may be —OR, —NRR');

R may be a linear or branched hydrocarbyl group (typically the hydrocarbyl group may contain 4 to 40, or 6 to 30, or 8 to 20 carbon atoms), an alkoxy group or an aryloxy group; and R' may be hydrogen, or a linear or branched hydrocarbyl group (typically the hydrocarbyl group may contain 4 to 40, or 6 to 30, or 8 to 20 carbon atoms), an alkoxy group or an aryloxy group.

In one embodiment the present invention provides a lubricating composition comprising an oil of lubricating viscosity and a nitrile compound represented by formula (1a):

formula (1a)

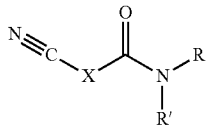

wherein

X may be a linear or branched hydrocarbylene group, or a heteroatom-containing hydrocarbylene group (such as —$CH_2$—O—$CH_2$—, or —$CH_2CH_2$—O—$CH_2CH_2$—, or —$C(CH_3)H$—$OCH_2$— or —$C(CH_3)HCH_2$—O—$CH_2CH_2$—, (typically X may be a linear or branched hydrocarbylene group);

R may be a linear or branched hydrocarbyl group (typically the hydrocarbyl group may contain 4 to 40, or 6 to 30, or 8 to 20 carbon atoms), an alkoxy group or an aryloxy group; and R' may be hydrogen, or a linear or branched hydrocarbyl group (typically the hydrocarbyl group may contain 4 to 40, or 6 to 30, or 8 to 20 carbon atoms), an alkoxy group or an aryloxy group.

In one embodiment the nitrile compound represented by the formula (1a) may have an R group having 10 to 15, or 12 to 15 or 12 to 14 carbon atoms. The R group may also be linear.

In one embodiment the present invention provides a lubricating composition comprising an oil of lubricating viscosity and a nitrile compound represented by the formula (1b):

formula (1b)

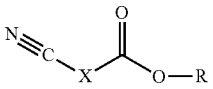

wherein

X may be a linear or branched hydrocarbylene group, or a heteroatom-containing hydrocarbylene group (such as —$CH_2$—O—$CH_2$—, or —$CH_2CH_2$—O—$CH_2CH_2$—, or —$C(CH_3)H$—$OCH_2$— or —$C(CH_3)HCH_2$—O—$CH_2CH_2$—, (typically X may be a linear or branched hydrocarbylene group); and R may a linear or branched hydrocarbyl group (typically the hydrocarbyl group may contain 4 to 40, or 6 to 30, or 8 to 20 carbon atoms), an alkoxy group or an aryloxy group.

In one embodiment the nitrile compound represented by the formula (1b) may have an R group having 10 to 15, or 12 to 15 or 12 to 14 carbon atoms. The R group may also be branched.

In one embodiment the present invention provides a lubricating composition comprising an oil of lubricating viscosity and a nitrile compound represented by the formula (1c):

formula (1c)

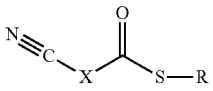

wherein

X may be a linear or branched hydrocarbylene group, or a heteroatom-containing hydrocarbylene group (such as —$CH_2$—O—$CH_2$—, or —$CH_2CH_2$—O—$CH_2CH_2$—, or —$C(CH_3)H$—$OCH_2$— or —$C(CH_3)HCH_2$—O—$CH_2CH_2$—, (typically X may be a linear or branched hydrocarbylene group);

R may a linear or branched hydrocarbyl group (typically the hydrocarbyl group may contain 4 to 40, or 6 to 30, or 8 to 20 carbon atoms).

In one embodiment the present invention provides a lubricating composition comprising an oil of lubricating viscosity and a nitrile compound represented by the formula (1d):

formula (1d)

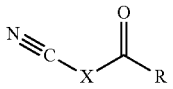

wherein

X may be a linear or branched hydrocarbylene group, or a heteroatom-containing hydrocarbylene group (such as —$CH_2$—O—$CH_2$—, or —$CH_2CH_2$—O—$CH_2CH_2$—, or —$C(CH_3)H$—$OCH_2$— or —$C(CH_3)HCH_2$—O—$CH_2CH_2$—, (typically X may be a linear or branched hydrocarbylene group);

R may a linear or branched hydrocarbyl group (typically the hydrocarbyl group may contain 4 to 40, or 6 to 30, or 8 to 20 carbon atoms), alkoxy group or aryloxy group. In one embodiment R may be alkyl, aryl, alkaryl, alkoxy, or aryloxy.

In one embodiment the present invention provides a lubricating composition comprising an oil of lubricating viscosity and a nitrile compound obtained/obtainable by a process comprising reacting a cyano-substituted carboxylic acid with a compound selected from the group consisting of an alcohol and an amine.

In one embodiment the invention provides a lubricating composition wherein the nitrile compound may be present at 0.01 wt % to 5 wt %, or 0.05 wt % to 2.5 wt %, or 0.1 wt % to 2 wt %, or 0.25 wt % to 1.5 wt %, or 0.5 wt % to 1 wt %.

In one embodiment the invention provides a method of lubricating an internal combustion engine comprising supplying to the internal combustion engine a lubricating composition as disclosed herein.

In one embodiment the invention provides for the use of the nitrile compounds above as an antioxidant, an antiwear agent, friction modifier, extreme pressure agent, or lead or copper (typically lead) corrosion inhibitor.

In one embodiment the invention provides for the use in an internal combustion engine of the nitrile compounds above as an antioxidant, an antiwear agent, friction modifier, extreme pressure agent, or lead or copper (typically lead) corrosion inhibitor.

In one embodiment the invention provides for the use of a nitrile compound obtained/obtainable by a process comprising reacting a cyano-substituted carboxylic acid with an alcohol as a lubricant additive capable of being an antioxidant, an antiwear agent, extreme pressure agent or a friction modifier (typically to improve fuel economy). The resultant nitrile compound may have a similar structure as formulae (1b) (i.e., when Z=—OR).

In one embodiment the invention provides for the use of a nitrile compound obtained/obtainable by a process comprising reacting a cyano-substituted carboxylic acid with an alcohol as an internal combustion engine lubricant additive capable of being an antioxidant, an antiwear agent, extreme pressure agent or a friction modifier (typically to improve fuel economy).

In one embodiment the invention provides for the use of a nitrile compound obtained/obtainable by a process comprising reacting a cyano-substituted carboxylic acid with an amine as a copper corrosion additive and/or friction modifier (particularly for enhancing fuel economy). The resultant nitrile compound may have a similar structure as formulae (1a) (i.e., when Z=—NRR').

In one embodiment the invention provides for the use of a nitrile compound obtained/obtainable by a process comprising reacting a cyano-substituted carboxylic acid with an amine as an internal combustion engine copper corrosion additive and/or friction modifier (particularly for enhancing fuel economy).

DETAILED DESCRIPTION OF THE INVENTION

The present invention provides a lubricating composition, a method for lubricating an engine as disclosed above, and a use of the nitrile compounds as disclosed above.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is provided in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Nitrile Compound

The nitrile compound described herein may in different embodiments be represented by formulae (2) to (11):

(2)

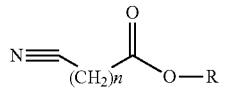

(3)

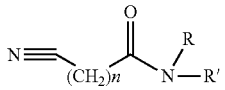

(4)

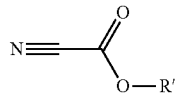

(5)

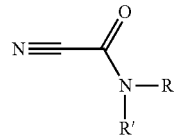

(6)

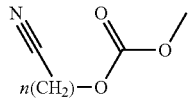

(7)

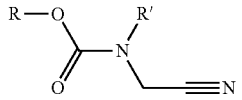

(8)

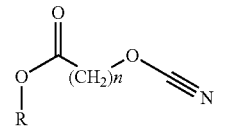

(9)

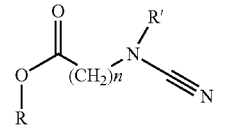

(10)

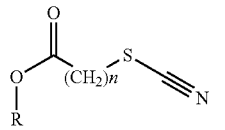

(11)

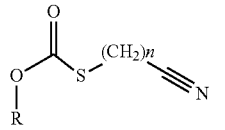

wherein n ranges from 0 to 6, or 1 to 4, or 0 to 3, or 1 to 3 (typically 1 to 3, or 1);

R may be a hydrocarbyl group (typically the hydrocarbyl group may contain 4 to 40, or 6 to 30, or 8 to 20 carbon atoms); and R' may be hydrogen, or a hydrocarbyl group (typically the hydrocarbyl group may contain 4 to 40, or 6 to 30, or 8 to 20 carbon atoms).

In one embodiment the nitrile compound in different embodiments may be represented by formulae (2), (3), (6), (7), and (11). In one embodiment the nitrile compound in different embodiments may be represented by formulae (2) and (3).

The nitrile compound may be derived from a cyano-substituted carboxylic acid. The cyano-substituted carboxylic acid may include a number of acids. The acids may include classes of compounds such as a cyano-alkanoic acid, a cyano-alkenoic acid, a carbonic acid mono-(cyano-alkyl) ester, a thiocarbonic acid S-cyanoalkyl ester, or mixtures thereof. In one embodiment the cyano-substituted carboxylic acid may be a cyano-alkanoic acid, or mixtures thereof.

The cyano-alkanoic acid may include cyanoethanoic acid, 2-cyanopropanoic acid, 3-cyanopropanoic acid, 2-cyanobutanoic acid, 3-cyanobutanoic acid, 4-cyanobutanoic acid, 2-cyanopentanoic acid, 3-cyanopentanoic acid, 4-cyanopentanoic acid, 5-cyanopentanoic acid, or mixtures thereof. In one embodiment the cyano-substituted carboxylic acid may be cyanoethanoic acid.

The carbonic acid mono-(cyano-alkyl) ester may include carbonic acid mono-(2-cyano-ethyl) ester, carbonic acid mono-(2-cyano-propyl) ester, carbonic acid mono-(3-cyano-propyl) ester, carbonic acid mono-(2-cyano-butyl) ester, carbonic acid mono-(3-cyano-butyl) ester, carbonic acid mono-(4-cyano-butyl) ester, carbonic acid mono-(2-cyano-pentyl) ester, carbonic acid mono-(3-cyano-pentyl) ester, carbonic acid mono-(4-cyano-pentyl) ester, carbonic acid mono-(5-cyano-pentyl) ester, or mixtures thereof.

The thiocarbonic acid S-cyanoalkyl ester may include thiocarbonic acid S-cyanomethyl ester, thiocarbonic acid S-cyanoethyl ester, thiocarbonic acid S-cyanopropyl ester, thiocarbonic acid S-cyanobutyl ester, thiocarbonic acid S-cyanopentyl ester or mixtures thereof.

The cyano-alkenoic acid may include 2-cyanopropenoic acid, 3-cyanopropenoic acid, 2-cyanobutenoic acid, 3-cyanobutenoic acid, 4-cyanobutenoic acid, 3-cyano-but-3-enoic acid, 4-cyano-but-3-enoic acid, 2-cyanopentenoic acid, 3-cyanopentenoic acid, 4-cyanopentenoic acid, 3-cyano-pent-3-enoic acid, 4-cyano-pent-3-enoic acid, or mixtures thereof.

The nitrile compound may be derived from the reaction of the cyano-substituted carboxylic acid with an alcohol or thiol. The alcohol and thiol may be represented by formulae $R(—OH)_m$ or $R(—SH)_m$ respectively, wherein R may contain 4 to 40, or 6 to 30, or 8 to 20 carbon atoms, and wherein m may be 1 to 10, or 1 to 6, or 1 to 2, or 1. The number of carbon atoms may for instance be 8 to 15, or 12 to 14. The alcohol R group may be a hydrocarbyl group, for example, alk(en)yl, aryl, or alkaryl (typically alk(en)yl including alkyl). The hydrocarbyl group R may be linear or branched, typically linear.

The alcohol may include butanol, 2-methylpentanol, 2-propylheptanol, 2-butyloctanol, 2-ethylhexanol, octanol, nonanol, isooctanol, isononanol, 2-tert-butylheptanol, decanol, undecanol, dodecanol, 2-methyldodecanol, tridecanol, 5-methyltridecanol, tetradecanol, pentadecanol, hexadecanol, 2-methylhexadecanol, heptadecanol, octadecanol, nonadecanol, eicosanol, cetyleicosanol, stearyleicosanol, docosanol eicosyltetratriacontanol, or mixtures thereof. Other useful alcohols include oleyl alcohol, stearyl alcohol, coco alcohol, tallow alcohol, or mixtures thereof.

Commercially available alcohols include Oxo Alcohol® 7911, Oxo Alcohol® 7900 and Oxo Alcohol® 1100 of Monsanto; Alphanol® 79 of ICI; Nafol® 1620, Alfol® 610, Alfol® 810 and Alfol® 1214 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann. In one embodiment the commercially available alcohol may be a mixture of linear alcohols such as those having 8 to 10 carbon atoms (Alfol® 810), or those having 12 to 14 carbon atoms (Alfol® 1214).

The thiol may include butane-1-thiol, butane-2-thiol, pentane-1-thiol, pentane-2-thiol, hexane-1-thiol, hexane-2-thiol, hexane-3-thiol, heptane-1-thiol, heptane-2-thiol, octane-1-thiol, octane-2-thiol, nonane-1-thiol, nonane-2-thiol, decane-1-thiol, decane-2-thiol, decane-3-thiol, decane-4-thiol, decane-5-thiol, dodecane-1-thiol (may also be called n-dodecylmercaptan), dodecane-2-thiol, t-dodecylmercaptan, or mixtures thereof.

The nitrile compound may be derived from the reaction of the cyano-substituted carboxylic acid with an alkoxy alcohol, or an aryloxy alcohol. The alkoxy alcohol or aryloxy (typically phenoxy) group as defined by R or R' may derived from oleyl ethoxylate, lauryl ethoxylate, stearyl ethoxylate, coco ethoxylate, tallow ethoxylate, oleyl propoxylate, lauryl propoxylate, stearyl propoxylate, coco propoxylate, tallow propoxylate, phenyl ethoxylate, tert-butyl phenyl ethoxylate, tert-butyl phenyl propoxylate, or mixtures thereof.

The nitrile compound may be derived from the reaction of the cyano-substituted carboxylic acid with an amine. The amine may be a monoamine, a diamine, or a polyamine, or an aminoalcohol, typically a monoamine, or an aminoalcohol. The amine may contain hydrocarbyl groups that may be alk(en)yl, aryl, or alkaryl. When the hydrocarbyl group contains an alk(en)yl group (or functional moiety) the carbon atoms may be linear or branched.

The monoamine may include a variety of amines having 4 to 30, or 6 to 20, or 8 to 18 carbon atoms. The monoamine may include, for example, butylamine, 2-methylpentamine, 2-propylheptamine, 2-butyloctamine, 2-ethylhexylamine, octylamine, nonylamine, isooctylamine, isononylamine, decylamine, undecylamine, dodecylamine, 2-methyldodecylamine, tridecylamine, tetradecylamine, pentadecylamine, hexadecylamine, 2-methylhexadecylamine, heptadecylamine, octadecylamine, nonadecylamine, eicosylamine, cetyleicosylamine, stearyleicosylamine, docosylamine and/or triacontylamine. Other useful monoamines include oleyl amine, stearyl amine, coco amine, tallow amine, or mixtures thereof.

The aminoalcohol may include ethanolamine, isopropanolamine, diethanolamine, triethanolamine, diethyl ethanolamine, dimethylethanolamine, dibutylethanolamine, 3-amino-1,2-propanediol, serinol, 2-amino-2-methyl-1,3-propanediol, tris(hydroxymethyl)-aminomethane, N-methylglucamine, 1-amino-1-deoxy-D-sorbitol, diethanol amine, diisopropanolamine, N-methyl-N,N-diethanol amine, triethanolamine, N,N,N',N'-tetrakis(2-hydroxypropyl)ethylenediamine, 2-amino-2-methyl-1-propanol, 2-dimethylamino-methyl-1-propanediol, 2-amino-2-ethyl-1,3-propanediol, 2-amino-2-methyl-1,3-propanediol, 2-amino-1-butanol and mixtures thereof. In one embodiment the aminoalcohol may be ethanolamine, or diethanolamine.

The nitrile compound may be derived from the reaction of the cyano-substituted carboxylic acid with an aminoalcohol. The aminoalcohol may include ethanolamine, isopropanolamine, diethanolamine, triethanolamine, diethylethanolamine, dimethylethanolamine, dibutylethanolamine, 3-amino-1,2-propanediol; serinol; 2-amino-2-methyl-1,3-propanediol; tris(hydroxymethyl)-aminomethane; N-methylglucamine, 1-amino-1-deoxy-D-sorbitol; diethanol amine; diisopropanolamine; N-methyl-N,N-diethanolamine; triethanolamine; N,N,N',N'-tetrakis(2-hydroxypropyl)ethylenediamine, 2-amino-2-methyl-1-propanol, 2-dimethylamino-methyl-1-propanediol, 2-amino-2-ethyl-1,3-propanediol, 2-amino-2-methyl-1,3-propanediol, 2-amino-1-butanol and mixtures thereof.

The nitrile compounds disclosed herein may be prepared by a process comprising reacting a cyano-substituted carboxylic acid with a compound selected from the group consisting of an alcohol, a thiol, an amine and an aminoalcohol.

In one embodiment the nitrile compounds disclosed herein may be prepared by a process comprising reacting a cyano-substituted carboxylic acid with a compound selected from the group consisting of an alcohol, and an amine.

The mole ratio of cyano-substituted carboxylic acid to any one of the alcohol, the amine or the aminoalcohol may range from 5:1 to 1:5, or 2:1 to 1:2, or 1:1.

The reaction to prepare the compound of the present invention may be performed in a variety of different reaction conditions. The reaction may be carried out at a reaction temperature in the range of 70° C. to 200° C., or 90° C. to 180° C., or 100° C. to 160° C. The reaction may be carried out in an inert atmosphere e.g., under nitrogen, or argon, typically nitrogen. The reaction may be performed in the presence or absence of a solvent (typically including a solvent). The solvent includes an aromatic hydrocarbon solvent. The reaction may be carried out in the absence or presence of catalyst (typically in the presence of a catalyst). The catalyst may be a sulphonic acid, such as methane sulphonic acid, toluene sulphonic acid, benzene sulphonic acid, or $C_{12}H_{25}$-alkyl sulphonic acid. The catalyst may also include metal salts of titanium, zirconium or aluminium that have counterions of chloride, bromide, iodide, or alkoxides (wherein alkyl group on the alkoxide may have 1 to 20, or 1 to 4 carbon atoms), or mixtures thereof. The catalyst may also include a phosphoric acid of formula HO—$(P(O)(OH)O)_e$—H, where e may be 1 to 5, or 2 to 5. In one embodiment the catalyst may be a sulphonic acid, typically methane sulphonic acid.

Examples of an aromatic hydrocarbon solvent include aromatic hydrocarbon solvent such as Shellsolv AB® (commercially available from Shell Chemical Company); and toluene extract, Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

A lubricating composition may be prepared by adding the product of the process described herein to an oil of lubricating viscosity, optionally in the presence of other performance additives (as described herein below).

In one embodiment the nitrile compounds disclosed herein may be prepared by a process comprising reacting in step (1) acrylonitrile with either a carbonic acid or a thiocarbonic acid to form an intermediate product, then step (2) reacting the intermediate product of step (1) with a compound selected from the group consisting of an alcohol and a thiol.

The reaction conditions of this process may be to combine the reactants at room temperature and atmospheric pressure with toluene, add a catalytic amount of methanesulfonic acid, and heat to toluene reflux. In the case of using a carboxylic acid as a starting material, water will be azeotropically removed. Upon completion of the reaction, the solvent can be removed under reduced pressure.

The reaction conditions of step (2) may be similar to those described previously (in paragraph [0059]) for reacting the cyano-substituted carboxylic acid with the alcohol, thiol, amine or aminoalcohol.

Other Performance Additives

The composition optionally comprises other performance additives. The other performance additives may include at least one of metal deactivators, viscosity modifiers, detergents, friction modifiers (other than the nitrile of the present invention), antiwear agents (other than the nitrile of the present invention), corrosion inhibitors (other than the nitrile of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent (other than the nitrile of the present invention), a dispersant viscosity modifier, a friction modiffier (other than the nitrile of the present invention), a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutyleve succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof.

The overbased detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described, for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be a sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at or 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylpho sphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the friction modifier may be selected from the group consisting of long chain fatty acid derivatives of amines, fatty esters, or fatty epoxides; fatty alkyl tartrates; fatty alkyl tartrimides; and fatty alkyl tartramides. The fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a (tri)glyceride.

Other performance additives such as corrosion inhibitors include those described in paragraphs 5 to 8 of WO2006/047486, octyl octanamide, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including polysiloxane or copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Nitrile Compound | 0.05 to 2.5 | 0.1 to 2 | 0.25 to 1.5 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

The lubricating composition may be utilised in an internal combustion engine. The engine components may have a surface of steel or aluminium (typically a surface of steel).

An aluminium surface may be derived from an aluminium alloy that may be a eutectic or hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

The following examples provide illustrations of the invention. These examples are non-exhaustive and are not intended to limit the scope of the invention.

EXAMPLES

Preparative Example 1 (EX1)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 165 g of cyanoacetic acid, 282 g of Alfol®810 alcohol, 195 g of toluene (solvent) and methane sulphonic acid (catalyst, 2.8 g). The reaction is heated to 110° C. and held for one hour. The flask is then heated to 115° C. and held for 6 hours to azeotrope water (obtain 31.5 g). The flask is then heated to 120° C. and held for 8 hours. The flask is then vacuum stripped at 2.67 kPa (or about 20 mm Hg) for 2 hours. The resultant product is then filtered through a diatomaceous filter (Fax-5™). 350 g of product is obtained.

Preparative Example 2 (EX2)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 166 g of cyanoacetic acid, 391 g of Alfol®1214 alcohol, 140 g of toluene (solvent) and methane sulphonic acid (catalyst, 2.8 g). The reaction is heated to 120° C. and held for 4 hours to azeotrope water (obtain 32.9 g). The flask is then maintained at 120° C. for 4 more hours. The flask is then vacuum stripped at 2.67 kPa (or about 20 mm Hg) for 2 hours. The resultant product is then filtered through a diatomaceous filter (Fax-5™). 448 g of product is obtained.

Preparative Example 3 (EX3)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 161 g of cyanoacetic acid, 247 g of 2-ethylhexanol, 176 g of toluene (solvent) and methane sulphonic acid (catalyst, 2.7 g). The reaction is heated to 120° C. and held for 4 hours to azeotrope water (obtain 32.9 g). The flask is then maintained at 120° C. for 4 more hours. The flask is then vacuum stripped at 2.67 kPa (or about 20 mm Hg) for 2 hours. The resultant product is then filtered through a diatomaceous filter (Fax-5™). 265 g of product is obtained.

Preparative Example 4 (EX4)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 200 g of cyanoacetic acid and 126 g of xylene (solvent). The flask is heated to 80° C. until cyanoacetic acid dissolves. The flask is then heated to 120° C. 304 g of octylamine is added dropwise. The flask is then heated to 130° C. and held for 8 with continued dropwise addition of octylamine. 40.8 g of water is obtained. The flask is then heated to 140° C. for 6 hours. The contents of the flask are then vacuum stripped at 2.67 kPa (or about 20 mm Hg) for 2 hours. The resultant product is then filtered through a diatomaceous filter (Fax-5™). 292 g of product is obtained.

Preparative Example 5 (EX5)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 200 g of cyanoacetic acid and 126 g of xylene (solvent). The flask is heated to 80° C. until cyanoacetic acid dissolves. The flask is then heated to 120° C. 304 g of 2-ethylhexylamine is added dropwise. The flask is then heated to 130° C. and held for 8 with continued dropwise addition of 2-ethylhexylamine. 39.5 g of water is obtained. The flask is then heated to 140° C. for 6 hours. The contents of the flask are then vacuum stripped at 2.67 kPa (or about 20 mm Hg) for 2 hours. The resultant product is then filtered through a diatomaceous filter (Fax-5™). 273.1 g of product is obtained.

Preparative Example 6 (EX6)

A 1 liter flange flask is fitted with PTFE gasket, flange lid, nitrogen inlet providing a nitrogen flow of 0.5 $cm^3$/min, thermocouple, overhead stirrer with PTFE gland and Dean-Stark trap fitted with double wall water cooled condenser. The flask is charged with 100 g of cyanoacetic acid and 104 g of xylene (solvent). The flask is heated to 80° C. until cyanoacetic acid dissolves. The flask is then heated to 120° C. 316 g of oleylamine is added dropwise. The flask is then heated to 130° C. and held for 8 with continued dropwise addition of oleylamine. 19.4 g of water is obtained. The flask is then heated to 140° C. for 6 hours. The contents of the flask are then vacuum stripped at 2.67 kPa (or about 20 mm Hg) for 2 hours. The resultant product is then filtered through a diatomaceous filter (Fax-5™). 350.8 g of product is obtained.

Test 1: Wear and Friction Performance of Ester-Containing Compounds

A series of SAE 5W-30 engine lubricants (IVL1 to IVL3) are prepared containing antioxidants (mixture of hindered phenols and alkylated diphenylamines), 500 ppm of phosphorus delivered from zinc dialkyldithiophosphate, an overbased calcium sulphonate detergent, a succinimide dispersant, and further containing 1 wt % of the product obtained in EX1, EX2 or EX3 respectively.

Comparative Example 1 (CE1) is a SAE 5W-30 engine lubricant similar to INVL1, except it does not contain a nitrile compound of the present invention.

The SAE 5W-30 lubricants INVL1 to INVL3 and CE1 are evaluated for wear and friction performance in a Cameron-TE-77™ reciprocating wear tester. A 6 mm steel ball is reciprocated against a steel plate while immersed in 12 mL of the test oil. Prior to evaluation, the oil is oxidatively stressed with 1 wt % cumene hydroperoxide at ambient temperature. Once immersed in the stressed oil, the rig is heated to 150° C. and the ball is applied to the plate with a 100N load. The pieces are rubbed at 20 hz for 72 minutes at 150° C. with a stroke length of 2.5 mm. The wear scar on the ball is measured along two perpendicular axis and averaged. The coefficient of friction is also averaged over the entire 72 minutes of the experiment and recorded.

The results obtained are:

| | CE1 | INVL1 | INVL2 | INVL3 |
|---|---|---|---|---|
| Wear Scar (μm) | 604 | 353 | 337 | 391 |
| Coefficient of Friction | 0.12 | 0.08 | 0.10 | 0.10 |

The data presented indicates that the lubricating composition of the invention (for example, an internal combustion engine lubricant) containing a nitrile compound having an ester group as described by the invention provides one or more of antiwear performance, friction modifier (particularly for enhancing fuel economy) performance, or extreme pressure performance.

Test 2: Corrosion and Friction Performance of Amide-Containing Compounds

A series of SAE 5W-30 engine lubricants (IVL4 to IVL9) are prepared containing antioxidants (mixture hindered phenols and alkylated diphenylamines), 500 ppm of phosphorus delivered from zinc dialkyldithiophosphate, a mixture of calcium sulphonate detergents, a succinimide dispersant, and further containing a product obtained from EX4 to EX6 respectively. In particular IVL4 contains 0.5 wt % of EX4, IVL5 contains 0.5 wt % of EX5, and IVL6 contains 0.5 wt % of EX6. IVL7 contains 1 wt % of EX4, IVL8 contains 1 wt % of EX5, and IVL9 contains 1 wt % of EX6.

Comparative Example 2 (CE2) is a lubricant similar to IVL4, except it does not contain a product of EX4 to EX6.

IVL4, IVL7 and CE2 are then evaluated for performance by the methodology of ASTM Methods D6594-08 (test method covers testing diesel engine lubricants to determine their tendency to corrode various metals, specifically alloys of lead and copper commonly used in cam followers and bearings) and D130-04e1 (copper corrosion strip test). The lubricants are also evaluated by coefficient of friction by SRV (in Oscillation, friction and wear test). The friction characteristics of the lubricants are evaluated using a SRV reciprocating dynamic friction tester by OPTIMOL with a cylinder on flat geometry. The tests were carried out at a load of 400N, at a frequency of 50 Hz, at a 1 mm stroke, and the temperature is ramped from 40° C. to 120° C. over 45 minutes. The average friction coefficient for the last 15 minutes is reported. The results obtained for IVL4, IVL7 and CE2 are shown below:

| | CE2 | IVL4 | IVL7 |
|---|---|---|---|
| D6594-08 Copper (ppm) | 36 | 8 | 8 |
| D130 | 4A | 1B | 1B |
| SRV Coefficient of Friction | 0.164 | 0.125 | 0.115 |

The data presented indicates that the lubricating composition of the invention (for example, an internal combustion engine lubricant) containing a nitrile compound having an amide group as defined by the invention provides resistance to copper corrosion and friction modification (particularly for enhancing fuel economy).

Overall the data presented indicates that the lubricating composition of the invention (for example, an internal combustion engine lubricant) containing a nitrile compound of the invention provides one or more of antiwear performance, friction modifier (particularly for enhancing fuel economy) performance, extreme pressure performance or resistance to corrosion.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used here the term "alk(en)yl" includes alkyl and alkenyl.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

As used herein the term "hydrocarbylene" is used in a similar way as hydrocarbyl, except where the hydrocarbyl group has a carbon atom directly attached to the remainder of the molecule e.g., an alkyl group. In contrast, a hydrocarbylene group is attached to two atoms within the molecule e.g., an alkylene group (e.g., —$CH_2CH_2CH_2$—).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating an internal combustion engine comprising supplying to the internal combustion engine a lubricating composition comprising an oil of lubricating viscosity and a nitrile compound, wherein the nitrile compound is represented by formula (1a):

formula (1a)

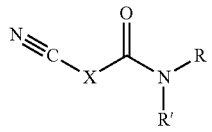

wherein

X is a linear or branched hydrocarbylene group, or a heteroatom-containing hydrocarbylene group;

R is a linear or branched hydrocarbyl group, an alkoxy group or an aryloxy group; and R' is hydrogen, or a linear or branched hydrocarbyl group, an alkoxy group or an aryloxy group.

2. A method of lubricating an internal combustion engine comprising supplying to the internal combustion engine a lubricating composition comprising an oil of lubricating viscosity and a nitrile compound, wherein the nitrile compound is represented by formula (1c):

formula (1c)

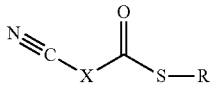

wherein

X is a linear or branched hydrocarbylene group, or a heteroatom-containing hydrocarbylene group;

R is a linear or branched hydrocarbyl group.

3. A method of lubricating an internal combustion engine comprising supplying to the internal combustion engine a lubricating composition comprising an oil of lubricating viscosity and a nitrile compound, wherein the nitrile compound is represented by formula (1d):

formula (1d)

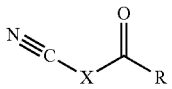

wherein

X is a linear or branched hydrocarbylene group, or a heteroatom-containing hydrocarbylene group; and R is a linear or branched hydrocarbyl group, alkoxy group or aryloxy group.

4. The lubricating composition of claim 1, wherein the nitrile compound is present at 0.05 wt % to 2.5 wt %.

5. The lubricating composition of claim 1, wherein the nitrile compound is present at 0.1 wt % to 2 wt %.

6. The lubricating composition of claim 1, wherein the nitrile compound is present at 0.25 wt % to 1 wt % of the lubricating composition.

7. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

8. The lubricating composition of claim 1, wherein the lubricating composition further comprises a dispersant viscosity modifier.

9. The lubricating composition of claim 1, wherein the lubricating composition further comprises a phosphorus-containing antiwear agent comprising a zinc dialkyldithiophosphate.

10. The lubricating composition of claim 1, wherein the lubricating composition further comprises an overbased detergent selected from the group consisting of phenates, sulphur containing phenates, sulphonates, salixarates, salicylates, and mixtures thereof.

11. The lubricating composition of claim 1, wherein the engine has a cylinder bore, cylinder block, or piston ring having a steel surface.

12. The lubricating composition of claim 2, wherein the nitrile compound is present at 0.05 wt % to 2.5 wt %.

13. The lubricating composition of claim 2, wherein the nitrile compound is present at 0.1 wt % to 2 wt %.

14. The lubricating composition of claim 2, wherein the nitrile compound is present at 0.25 wt % to 1 wt % of the lubricating composition.

15. The lubricating composition of claim 2, wherein the lubricating composition is characterised as having (i) a sulphur content of 0.5 wt % or less, (ii) a phosphorus content of 0.1 wt % or less, and (iii) a sulphated ash content of 1.5 wt % or less.

16. The lubricating composition of claim 3, wherein the nitrile compound is present at 0.05 wt % to 2.5 wt %.

17. The lubricating composition of claim 3, wherein the nitrile compound is present at 0.1 wt % to 2 wt %.

18. The lubricating composition of claim 3, wherein the nitrile compound is present at 0.25 wt % to 1 wt % of the lubricating composition.

19. The lubricating composition of claim 3, wherein the lubricating composition is characterised as having (i) a sulphur content of 0.5 wt % or less, (ii) a phosphorus content of 0.1 wt % or less, and (iii) a sulphated ash content of 1.5 wt % or less.

* * * * *